US006736739B1

(12) United States Patent
Epworth

(10) Patent No.: US 6,736,739 B1
(45) Date of Patent: May 18, 2004

(54) SOCCER TRAINING ASSEMBLY AND DEVICE

(76) Inventor: Leonard S. Epworth, 9206 Shady Tree Ct., Fiar Oaks, CA (US) 95628

( * ) Notice: Subject to any disclaimer, the term of this patent is extended or adjusted under 35 U.S.C. 154(b) by 0 days.

(21) Appl. No.: 09/245,937

(22) Filed: Feb. 5, 1999

(51) Int. Cl.[7] ..... A63B 69/34
(52) U.S. Cl. ..... 473/443
(58) Field of Search ..... 473/443, 430, 473/471, 446, 441, 442

(56) References Cited

U.S. PATENT DOCUMENTS 3,250,533 A * 5/1966 Nicholson ..... 482/83
3,387,842 A * 6/1968 Edgar ..... 482/83
3,637,210 A * 1/1972 Brantley ..... 473/443
3,765,675 A * 10/1973 DiMarzo ..... 473/446
4,168,062 A * 9/1979 McCathy et al. ..... 473/446
4,489,940 A * 12/1984 Amundson ..... 473/446
5,498,000 A * 3/1996 Cuneo ..... 473/471
5,928,093 A * 7/1999 Lai ..... 473/430

* cited by examiner

*Primary Examiner*—Paul T. Sewell
*Assistant Examiner*—M. Chambers
(74) *Attorney, Agent, or Firm*—Robert Samuel Smith

(57) ABSTRACT

A soccer training device, which fits into and is used in conjunction with a standard backyard soccer goal, uses a motorized simulated goalie. The goalie traverses across the mouth of the goal and a cam mechanism is used to impart an oscillating motion about the vertical axis of the goalie while traversing. A ball return device is included which returns the ball to the player after it has entered the mouth of the goal. A speed control varies the speed of the goalie enabling players of various ages and levels of skill to use the training device to hone their skills.

9 Claims, 6 Drawing Sheets

SOCCER TRAINING ASSEMBLY AND DEVICE

BACKGROUND OF THE INVENTION

This invention relates to a soccer training device and a soccer training assembly wherein the device is used in conjunction with a standard backyard soccer goal.

The growth of soccer in the United States during the past two decades has been quite rapid. U.S. Youth Soccer is the youth division of the United States Soccer Federation, the governing body of soccer in the United States. U.S. Youth Soccer registers young players between the ages of 5 and 19 and is made up of 55 member state associations, one in each state, with two in California, New York, Ohio, Pennsylvania and Texas. The U.S. Youth Soccer Association has seen exponential growth in recent years. It had 1.4 million members in 1988 and 1.7 million in 1991. It now has more than 3,000,000 registered members. It is a member of a much larger soccer community. Boys and girls register to play with one of the 6,000+ clubs and leagues formed by their state association. U.S. soccer, along with more than 197 other national soccer organizations are members of the FIFA, the Federation Internationale de Football Association. The FIFA serves as the international governing body for soccer and U.S. Soccer has been a member since 1913.

In 1986, the United States Amateur Soccer Association, which represents players 19 years old and older, had only 96,000 members. It now counts more than 3,000,000 registered members. But the formal registrations figures only tell part of the story. According to the 1996 National Soccer Participation Survey, conducted by the Soccer Industry Counsel of America, there are nearly 17 million soccer participants in the U.S., more than 7 million are classified as frequent players (25 days or more a year).

It should be noted that approximately 44% of soccer playing Americans are women, showing that soccer has truly taken over as a sport for all young people. Now, with major league soccer having been launched, all these young players have new heroes to emulate, more news coverage to read and dreams to aspire to you, all of which combine to create a much stronger marketplace for soccer equipment and training devices than in the past.

Today, soccer is already, by far, the most popular participant sport among American youth, far out pacing the more traditional sports of baseball, football and basketball. In fact, soccer surpassed little league baseball more than 15 years ago and has continued to attract more youth players than any other widely organized team sport.

The problem is that, as with most team sports like baseball and football, it is difficult for individuals to practice the game of soccer alone. The solution then, is to create a device that will enable individuals to train for soccer, while maintaining long term interest, economically offering a variety of degrees of difficulty and making the product portable and easy to assemble by one person. Our research indicates that soccer is the most deficient of all sports with regards to individual training devices. Currently, there are no products on the market designed to help players hone their kicking and aiming skills without the help of a trainer/coach or other players. Previous attempts as such products have fallen short with regard to varying degrees of difficulty, maintaining the individual interests for extensive periods of time, and simulating true conditions of soccer as it is played.

Various types of sports training devices are known. U.S. Pat. No. 3,637,210 (Brantley) discloses a football dummy 36, flexibly suspended between two posts on a cable 15, which offers a moving target. The vertical height at one end is raised or lowered with crank 11 at the bottom of post 1 which causes the dummy to traverse between post 1 and post 2. A tubular spring housing 32 on the dummy 36 causes the dummy to reverse direction when it reaches the end of its traverse.

U.S. Pat. No. 3,765,675 (DiMarzio) discloses a simulated hockey goalie 11, which moves across the mouth of a simulated hockey net 17 via threaded column 13 riding a feed screw 14. The goalie 11 slides back and forth across the mouth of the simulated net 17 propelled by an electric driving motor 23. The player 26 stands at one end of a rectangular shaped room and shoots pucks 24 onto a surface 25 toward the net. An endless belt 31 moves the pucks toward the depressed trough 34. Another endless belt may be used to return the pucks to the player.

U.S. Pat. No. 3,840,228 (Greaney) discloses a device 22 which is fixedly attached to a ordinary hockey goal 11. The goalie is pivoted on the device 22 and the device is V-shaped so that when a player 16 propels the puck 17 toward the goalie, the puck is diverted to the right or the left. The player may score by propelling the puck through an opening through the legs of goalie. However, in this case the goalie and is stationery and, therefore, does not challenge the player as much as does a moving goalie.

U.S. Pat. No. 4,645,210 (Patsy) discloses a soccer training device consists of a moving target 18 mounted on a slide 17 driven by endless belt 27 attached to a motor. Limit switches 30 and 36 stop travel at each end or reversing switches are used to change the direction of the target. The target is open and may be in the shape of a square or circle.

U.S. Pat. No. 5,181,725 (Leras, et al.) discloses a soccer training shooting target which has a weight 22 attached to a top rope 24 which is connected to the upper edge of a target 21. The target 21 has an upper target 30, a center target 38 and lower target 48 at which the player 2 aims.

U.S. Pat. No. 5,271,624 (Sciortino) discloses a weighted body 2, which is attached to, and hangs down from, the cross-bar of a soccer goal G. The weighted body 2 defines a space between itself and the side post of the goal G at which a player P aims a ball B.

U.S. Pat. No. 5,503,402 (Moss, Jr.) discloses a practice focal device 12 which is removably attached to both a cross-bar member 82 and an upright post 88 of a soccer goal 82, defining an area at which the player aims a ball.

U.S. Pat. No. 5,628,515 (Levy) discloses a soccer training system having a visual target 12, which is mounted to the side post 36 of a soccer goal 30. The player practices by aiming a ball at the visual target which is attached to a hinge 22 to absorb the impact of the striking ball.

OBJECTS OF THE INVENTION

Accordingly, it is the general object of the invention to provide a soccer training assembly and device which improves upon, and is more effective and realistic than, exiting devices.

It is a further object of the instant invention to provide a soccer training assembly and device, which simulates conditions of an actual soccer game.

It is a yet a further object of the invention to provide a soccer training assembly and device which employs a simulated goalie which traverses the mouth of a standard backyard soccer goal while oscillating about its own axis.

It is still yet a further object of the instant invention to provide a soccer training assembly and device which is used in conjunction with a standard backyard soccer goal.

It is another object of the instant invention to provide a soccer training assembly and device with speed control to vary the difficulty faced by the player who is using the device.

It is still another object of the instant invention to provide a soccer training assembly and device which is inexpensive and easy to assemble and apply to a standard backyard soccer goal.

It is still yet another object of the instant invention to provide a soccer training assembly and device with an easily removable simulated goalie, so that the standard backyard soccer goal can be used for game play.

SUMMARY OF THE INVENTION

These an other objects of the instant invention are achieved by providing a soccer training assembly and device with a motor driven simulated goalie which traverses the mouth of a standard backyard soccer goal. The simulated goalie also oscillates about its own axis while it traverses the goal mouth. A ball return means is also included which returns the ball to the player after the ball has entered the mouth of the goal. The device includes a pair of uprights attached to a motor drive enclosure. The simulated goalie is attached to a motor driven goalie motion device mounted within the enclosure, which imparts a transverse and oscillating motion to the goalie A speed control varies the traversing and oscillating speeds of the simulated goalie. A disconnect pin allows the simulated goalie to be removed from the mouth of the goal, so that the goal can be used for game play.

DESCRIPTION OF THE DRAWINGS

Other objects of many of the intended advantages of this invention will be readily appreciated when the same becomes better understood by reference to the following detailed description when considered in connection with the accompanying drawings, wherein.

DETAILED DESCRIPTION OF THE PREFERRED EMBODIMENT

Figure 1:
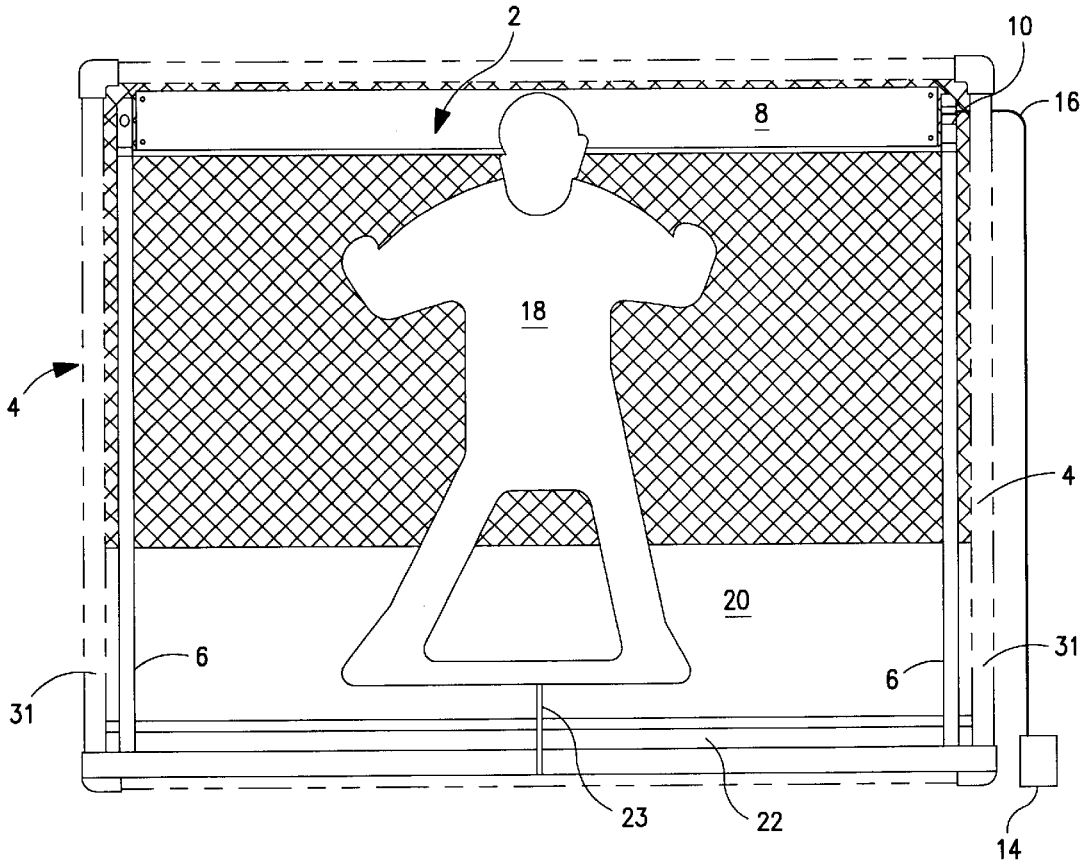
FIG. 1 is a front view of the training device installed within a standard backyard soccer goal.
Figure 2B:
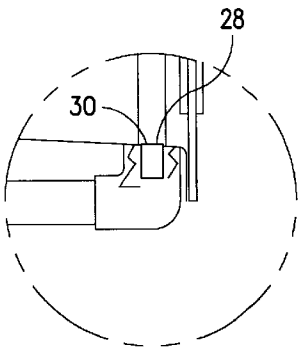
FIG. 2 is a side end view of the training device installed within a standard backyard soccer goal.
Figure 2A:
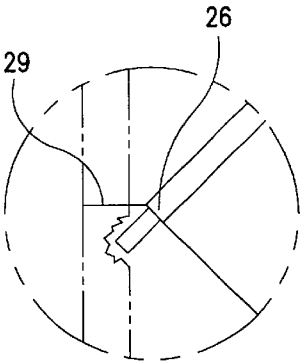
Figure 2:
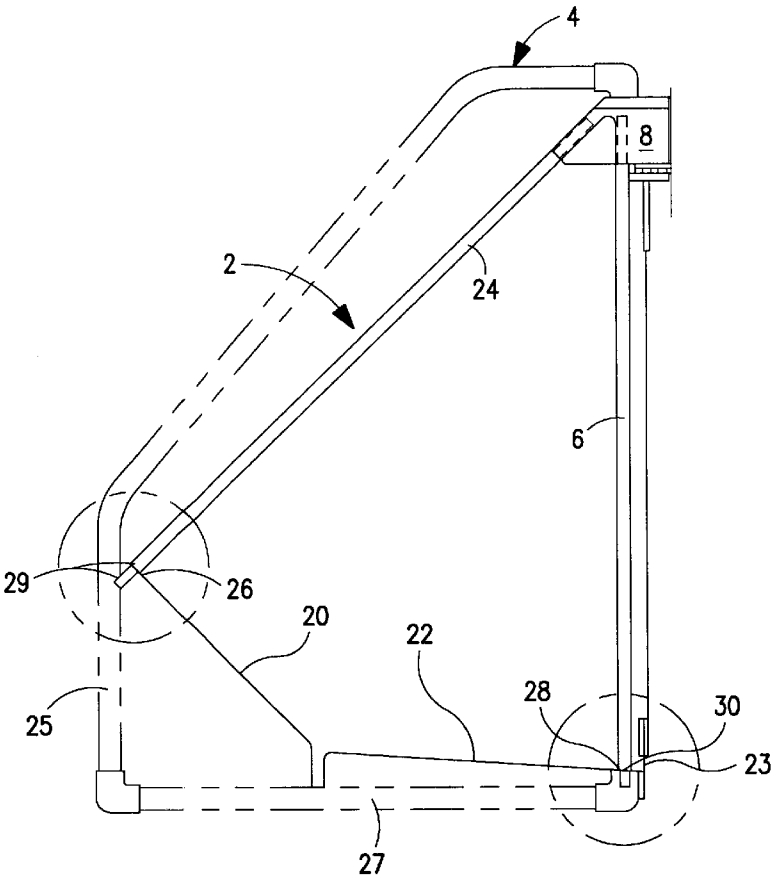

Referring now in detail to the various figures of the drawings, wherein like reference characters refer to like parts, there is shown in FIGS. 1 and 2 the soccer training device of the instant invention, which is installed in a standard backyard soccer goal 4. Typical dimensions for a backyard soccer goal are 6'wide, 5; high and 4'deep. The soccer training device 2 comprises a pair of uprights 6, one upright on each side of the entrance to the goal. A motor driving enclosure is shown having each end supported on the top end of one of the uprights opposite the other end supported on the top end of the other upright.

A goalie motion assembly is arranged to ride back and forth in the motor driving enclosure from one upright to the other.

A simulated goalie hangs from the goalie motion assembly. The simulated goalie hangs in a vertical "frontal" plane defined by the two uprights and travels back and forth between the uprights. The coupling of the goalie to the goalie motion assembly is arranged to cause the goalie to oscillate rotationally about a centerline (vertical axis) of the goalie as the goalie travels back and forth from near one upright to near the other upright. Power is applied to the device from a 12 volt rechargeable battery through a power cable 16. A switch controls power to the device and varies the speed of the simulated goalie.

The soccer training device 2 also includes a rear ball return plate 20, and a front ball return plate 22. The device also has a pair of rear sloping rods and a stabilizing rod 23 (FIG. 1) which is connected to the bottom of the simulated goalie 18. The stabilizing rod 23 rides along the front of the ball return plate 22 as the simulated goalie 18 traverses across the mouth of the goal 4, as will be explained later.

One end of each of the rear sloping rods 24 is connected to the bottom rear of the motor drive enclosure 8 (FIG. 2). The rear ball return plate 20 has a pair of openings 26, through which the other end of the rear sloping rods 24 are placed. One end of each of the uprights 6 is connected to the bottom of the motor drive enclosure 8 and the front ball return plate 22 has a pair of openings 28 through which each of the other ends of the uprights are placed. The ball return plates 20 and 22 may be made of steel or any other strong plate material.

FIG. 2A shows the entry of the rear slopping rods 24 through openings 26 into the rear ball return plate 20, while FIG. 2B shows the entry of the uprights 6 through the openings 28 in the front ball return plate 22.

The connection of the device 2 to the backyard standard goal 4 will now be explained. The rear ball return plate 20 has a second pair of openings 29 and the goal 4 has a pair of rear supports 25, each of which is placed through an opening 29. Similarly, the front ball return plate 22 has a second pair of openings 30 and the goal 4 has a pair of front supports 31, each of which are placed through an opening 30. Thus the front and rear ball return plates 20 and 22 are connected to the goal 4 and the rear sloping rods 24 and the uprights 6 of the device 2 are connected to the rear and front ball return plates 20 and 22 respectively as explained previously.

Figure 3:
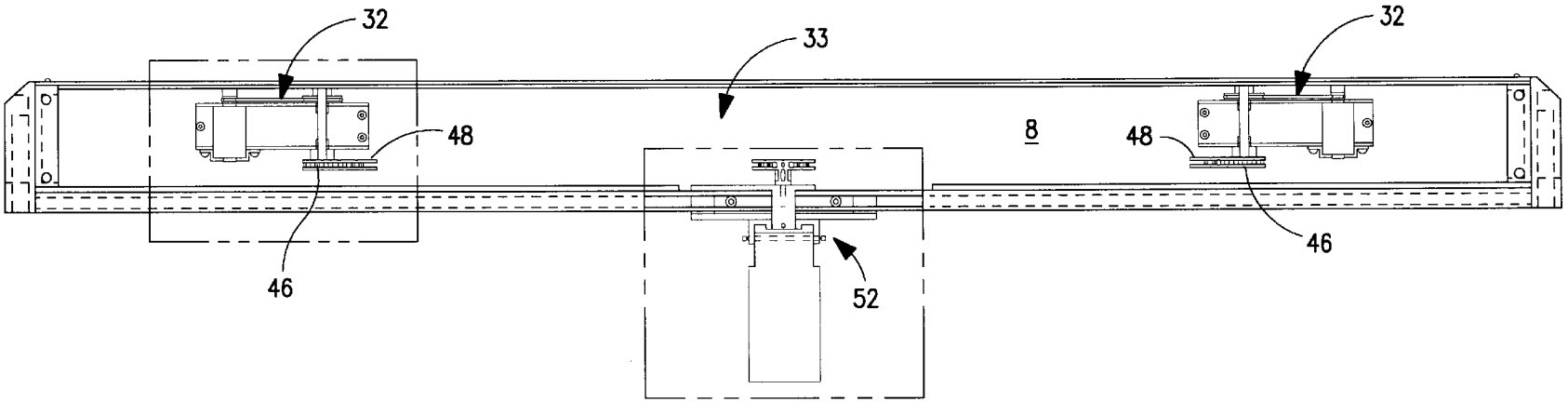
FIG. 3 is the front view of the actuator assembly of the soccer training device.
Figure 3B:
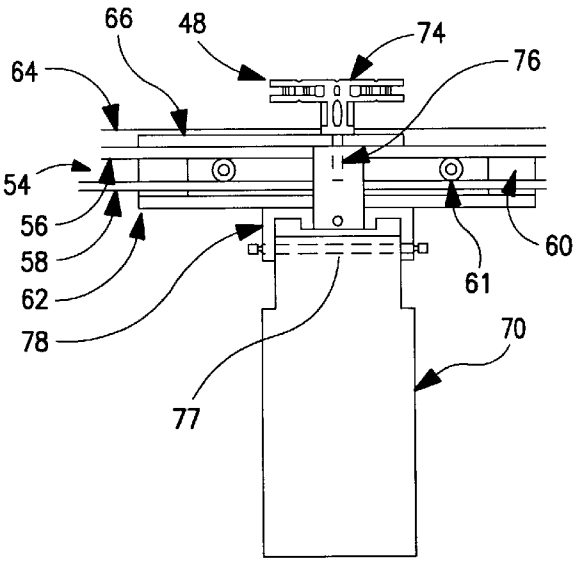
FIG. 3B is an enlarged view of the goalie motion assembly of the soccer training device.
Figure 3A:
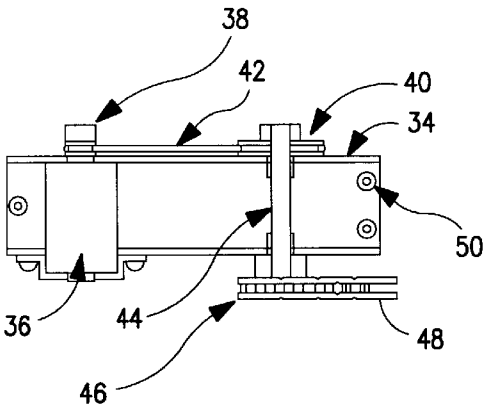
FIG. 3A is an enlarged view of the motor drive assembly of the soccer training device.

Referring now to FIGS. 3, 3A and 3B, the details of the motor drive are shown. As can be seen in the FIGS. 3 and 3A, the motor drive has a pair of housings 34 in each of which is mounted a motor 36, a drive pulley 38, a belt 42, a driven pulley 40, and a driven shaft 44 which has a cam sprocket 46. The motor drive also includes a chain 48, both ends of which connected to a goalie motion assembly 52 and which loop around each cam sprocket 46.

As can be seen in FIG. 3, the goalie motion assembly 52 travels back and forth between the motor drives 32 as the motor cause the chain 48 to progress. The details of the goalie motion assembly 52 are shown in FIG. 3B. The goalie motion assembly comprises a pair of vertical rollers 60, a pair of horizontal rollers 61, mounted in a housing 62. The pairs of rollers are confined to roll in an upper track and lower track 58 which form a channel 54 that extends the entire length of the motor drive enclosure 8, The rollers 60 and 61 ride in the channel 54 and serve to stabilize the motion of the goalie motion assembly 52 as it traverses back and forth between the motors 36. (The device 2 further includes a pair of limit switches, not shown, one at each end of the path of the simulated goalie 18, which reverse the direction of the simulated goalie 18 by reversing the polarity of the voltages to the motors 36. The cam actuated follower 66 rides on the upper track 56 and abuts the cam profile 64 which has undulating surfaces as will be explained later.

Figure 4A:
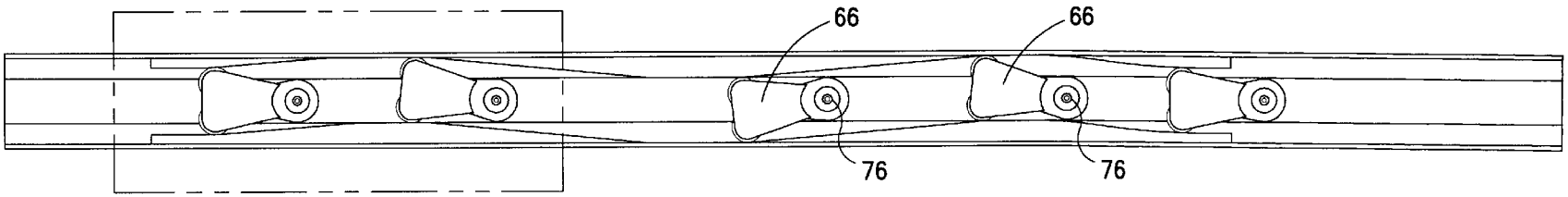
FIG. 4A shows the motion of the cam profile follower as it moves along the undulating surfaces of the cam profiles of the soccer training device.
Figure 4B:
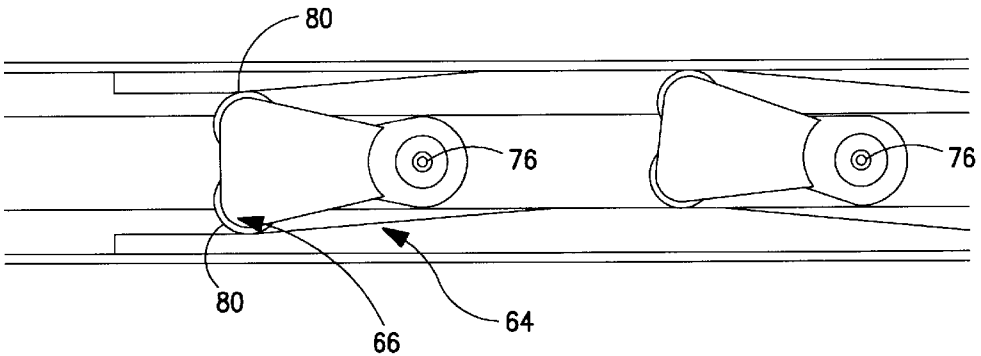
FIG. 4B is an enlarged view of the cam profile follower as it traverses along the cam profiles.
Figure 5:
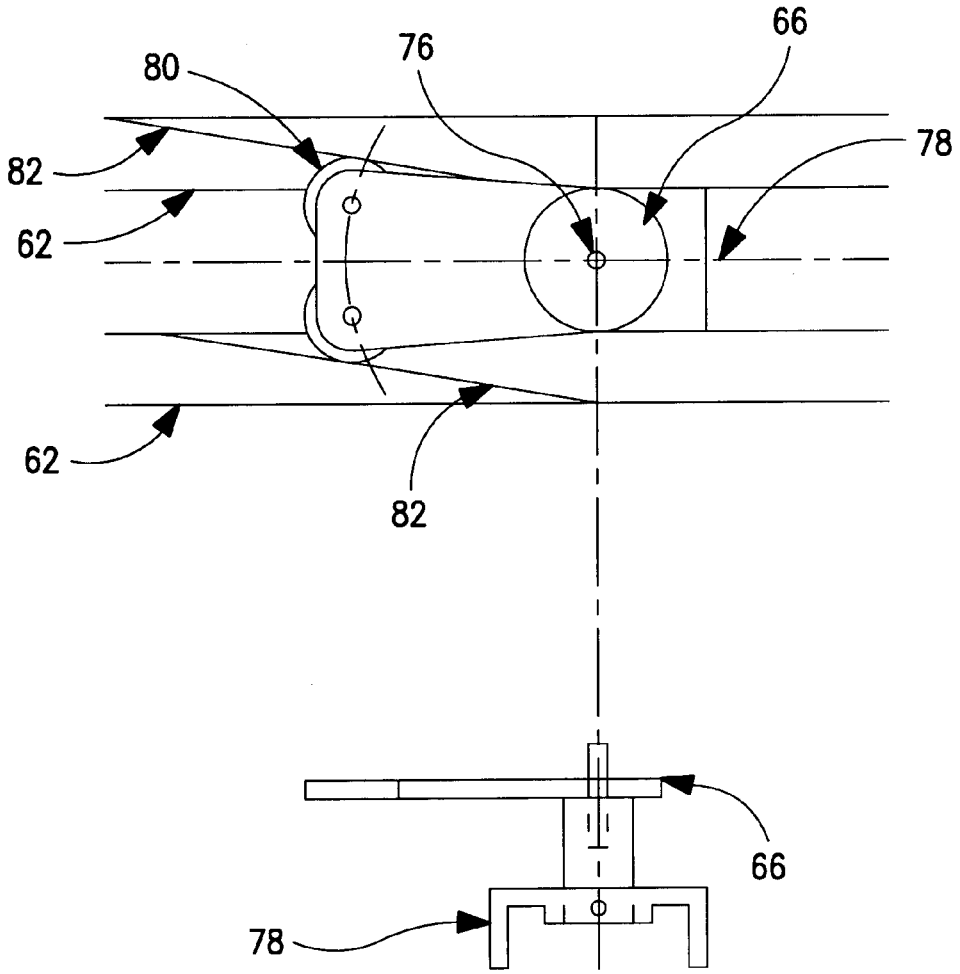
FIG. 5 shows the attachment of the cam follower to the clevis to which the simulated goalie is connected.

FIGS. 4A and 4B, show the movement of the cam actuated follower 66 as it moves transversely across the goal mouth. The cam actuated follower 66 has a pair of rollers 80, one on each side, which make contact with the cam profile 66. The goalie motion assembly 52 also includes a drive block 74 (FIG. 3) driven by the chain 48 and a drive pin 76 (FIG. B), which is connected to the drive block 74. As can be seen in FIGS. 4B and 5, the drive pin 76 rotates about its vertical axis (Z-axis) as the cam actuated follower 66 moves along cam profile's surface, the cam track 82.

The goalie motion assembly 52 further includes a drive pin 76 pivotally mounted in housing 62. A clevis 78 is secured by a drive block 76 to the drive pin 76. The simulated goalie 18 (not shown here) is attached to the strap 70 of clevis 78. The drive pin 76 is coupled to one end f the cam actuated follower 66. The simulated goalie is attached to the clevis strap 70. Thus the simulated goalie 18 is imparted with a rotational oscillation about the vertical axis through the drive pin 76 by the action of the cam actuated follower 66 coupled to the drive pin 76. Removal of the disconnect pin 77 disconnects the clevis strap 70 and therefore the simulated goalie from the device 2.

The simulated goalie 18 can be made of polycarbonate (LEXAN)TM or similar strong, lightweight material. In this case, wherein polycarbonate material is used, the simulated goalie 18 weighs only about 3 pounds, yet it is very strong and can withstand the shock of being struck with kicked soccer balls. Further, due to its light weight, the simulated goalie 18 can be easily removed from the front of the standard backyard goal 4 via the disconnect pin 77. Thus the device 2 can be used as a soccer practice device and with the simulated goalie 18 removed the soccer goal 4 can be used to play soccer.

Figure 6:
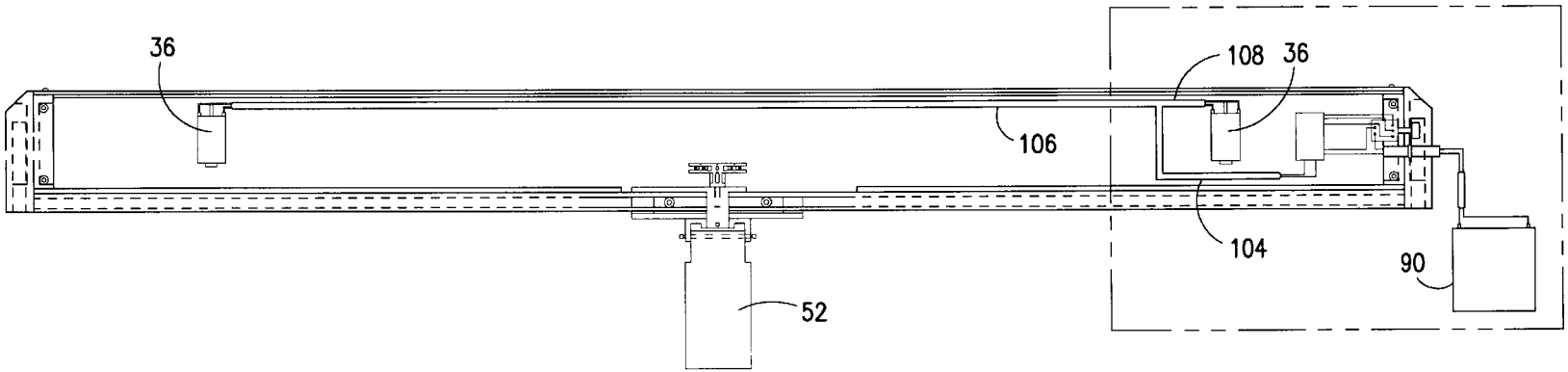
FIG. 6 shows the wiring layout of the soccer training device.
Figure 6A:
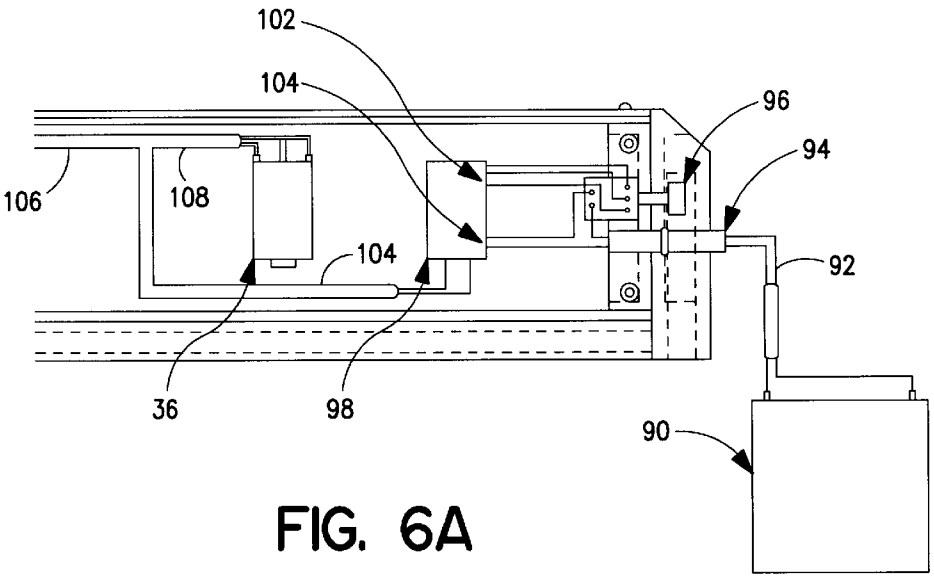
FIG. 6A is an enlarged view of the electrical components and wiring of the soccer training device.

The electrical system and wiring for the device 2 are shown in FIGS. 6 and 6A. The electrical system includes a battery 90, a cable 92, a connector 94, a combination speed control and on-off switch 96, a controller 98 which connects a voltage, which varies in accordance with the desired speed, to the motors 36 via lines 104, 106 and 108. Lines 100 and 102 carry the power input to the controller 98.

A soccer training device, which fits onto, and is used in conjunction with, a standard soccer goal, has been described. A motor driven simulated goalie 18 traverses across the goal mouth, while simultaneously oscillating about its own axis. This closely simulates actual playing conditions. A combination speed control and on-off switch is employed to apply power and to vary the speed of the simulated goalie, enabling players of various ages and levels of skill to use this device. It not only helps train players, but it is fun to use as well. Thus, interest in using the device and in continually practicing is maintained. In fact, the training device can be used for individual competitions between players, to see how many goals they can score while kicking a ball repetitively at the goal. The soccer goal can be used in the usual way by disconnecting the simulated goalie and removing it from the front of the goal. The device is easy to set up and install by one person.

Without further elaboration, the foregoing will so fully illustrate my invention that others may, by applying current or future knowledge readily adapt the same for use under the various conditions of service.

I claim:

1. A soccer training device for improving the skills of a player comprising:

(a) a means adapted for attaching said device to a standard backyard soccer goal, said standard backyard soccer goal having a goal mouth;

(b) a pair of front uprights adapted for positioning vertically, one said upright on one end of said mouth and another said upright on an opposite end of said mouth thereby defining a frontal plane coincident with said goal mouth;

(c) a pair of motor drive enclosures, one said enclosure mounted adjacent to a top end of one upright opposite said other enclosure mounted adjacent to a top of said other enclosure;

(d) a pair of motor drive assemblies, each said motor drive enclosure enclosing one of said pair of motor drive assemblies;

each said motor drive assembly including:

(i) a motor;

(ii) a pulley coupled to said motor by a belt respectively and having a driven shaft, (iii) a driven sprocket mounted on a free end of said driven shaft;

(iv) circuit means for repeatedly turning each said motor in a forward direction and then in a reverse direction in unison with said other motor;

(e) a continuous sprocket chain coupled to each said driven sprocket whereby said driven sprockets are coupled together;

(f) a goalie motion assembly between said uprights and having a second chain sprocket coupled to said continuous sprocket chain arranged to provide that, as said motors turn in unison, said chain moves and causes said goalie motion assembly to travers across said goal mouth between said motors;

(g) a channel extending between upper ends of said uprights having opposing undulating internal surfaces forming an upper and lower track with cam profiles;

(h) said goalie motion assembly including a cam follower with vertical rollers and a cam follower with horizontal rollers, said cam followers arranged to move within said channel as said goalie motion assembly traverses across said soccer goal mouth with said rollers in contact with said cam profiles as said goalie motion assembly traverses across said goal mouth;

(i) a simulated goalie;

(j) a means attached to said goalie and said goalie motion assembly means for causing said simulated goalie to oscillate rotationally about a vertical axis through said goalie while said goalie traverses the mouth of the goal; and (k) said means for hanging said goalie adapted for disconnecting said simulated goalie from said device;

(l) a drive pin connected to said cam profile follower with a clevis and a pivoting mount connected to said pin, with said pivoting mount connected to said simulated goalie arranged to that when said cam follower follows undulating surfaces of said cam profiles, said drive pin oscillates causing said simulated goalie to oscillate about its vertical axis.

2. The soccer training device of claim 1 further comprising a ball return means positioned in the soccer goal comprising a sloping rear return plate and a sloping ball front return plate.

3. The soccer training device of claim 2 further comprising a pair of rear sloping rods, each having one end connected to the bottom rear of said motor drive enclosure and wherein said rear return plate has a pair of openings into each of which the other end of each of said pair of sloping rods is placed and said front return plate has a pair of second openings into each of which each of the other ends of said front uprights is placed.

4. The soccer training device of claim 2 further comprising an electrical system comprising a storage battery connected to said motors, a combination speed control and on/off switch, a speed controller and a voltage regulator.

5. A soccer training device for improving the skills of a player comprising:

(a) a means adapted for attaching said device to a standard backyard soccer goal, said standard backyard soccer goal having a goal mouth;

(b) a pair of front uprights adapted for positioning vertically, one said upright on one end of said mouth and another said upright on an opposite end of said mouth thereby defining a frontal plane coincident with said goal mouth;

(c) a pair of motor drive enclosures, one said enclosure mounted adjacent to a top end of one upright opposite said other enclosure mounted adjacent to a top of said other enclosure;

(d) a pair of motor drive assemblies, each said motor drive enclosure enclosing one of said pair of motor drive assemblies;

each said motor drive assembly including:

(i) a motor;

(ii) a pulley coupled to said motor by a belt respectively and having a driven shaft, (iii) a driven sprocket mounted on a free end of said driven shaft;

(iv) circuit means for repeatedly turning each said motor in a forward direction and then in a reverse direction in unison with said other motor;

(e) a continuous sprocket chain coupled to each said driven sprocket whereby said driven sprockets are coupled together;

(f) a motor drive enclosure enclosing a goalie motion assembly between said uprights; said goalie motion assembly having a second chain sprocket coupled to said continuous sprocket chain arranged to provide that, as said motors turn in unison, said chain moves and causes said said goalie motion assembly to travers across said goal mouth between said motors;

(g) a channel with internal opposing surfaces defining an upper and a lower track extending between upper ends of said uprights;

(h) a pair of vertical rollers and a pair of horizontal roller mounted on said goalie motion assembly which move within said channel as said goalie motion assembly traverses said soccer goal mouth;

(i) a pair of cam profiles located within said enclosure and said goalie motion assembly further comprises a cam actuated follower with cam rollers in contact with said cam profiles, said cam profiles having undulating surfaces.

6. The soccer training assembly of claim 5 wherein said goalie motion assembly further comprises a drive pin connected to said cam profile follower, with a clevis and a pivoting mount connected to said pin, with said pivoting mount connected to said simulated goalie, so that when said cam profile follower follows the undulating surfaces of said cam profiles said drive pin oscillates, causing said simulated goalie to oscillate about its vertical axis.

7. The soccer training assembly of claim 6 further comprising a ball return means positioned in the soccer goal comprising a sloping rear return plate and a sloping ball front return plate.

8. The soccer training assembly of claim 7 further comprising a pair of rear sloping rods, each having one end connected to the bottom rear of said motor drive enclosure and wherein said rear return plate has a pair of openings into each of which the other end of each of said pair of sloping rods is placed and said front return plate has a pair of second openings into each of which each of the other ends of said front uprights is placed.

9. The soccer training assembly of claim 8 further comprising an electrical system comprising a storage battery connected to said motors, a combination speed control and on/off switch, a speed controller and a voltage regulator.

* * * * *